United States Patent [19]

Asphahani

[11] Patent Number: 4,533,414

[45] Date of Patent: Aug. 6, 1985

[54] CORROSION-RESISTANCE NICKEL ALLOY

[75] Inventor: Aziz I. Asphahani, Kokomo, Ind.

[73] Assignee: Cabot Corporation, Kokomo, Ind.

[21] Appl. No.: 168,237

[22] Filed: Jul. 10, 1980

[51] Int. Cl.[3] ..... C22C 19/05

[52] U.S. Cl. ..... 148/427; 148/428

[58] Field of Search ..... 75/171, 170; 148/32, 148/32.5

[56] References Cited

U.S. PATENT DOCUMENTS 1,836,317 12/1931 Franks ..... 75/171

3,203,792 8/1965 Scheil et al. ..... 75/171

*Primary Examiner*—R. Dean

*Attorney, Agent, or Firm*—J. Schuman; Joseph J. Phillips

[57] ABSTRACT

A nickel-base alloy containing principally chromium molybdenum and tungsten is disclosed. The alloy is especially resistant to corrosion in a variety of corrosive media including oxidizing acids and reducing acids; furthermore, the alloy is not subject to localized corrosive attack, known as the "pitting" test. The alloy nominally contains 22% chromium, 13% molybdenum, 3% tungsten, 3% iron and the balance nickel plus small amounts of adventitious elements and impurities. Molybdenum and tungsten must be present in a ratio of about 4 to 1 respectively for optimum benefits of the invention.

1 Claim, No Drawings

CORROSION-RESISTANCE NICKEL ALLOY

This invention relates to corrosion-resistant nickel base alloys and more particularly to nickel alloys containing, principally chromium, molybdenum and tungsten that resist corrosion when exposed to a variety of severe corrosive media.

PRIOR ART

Corrosion-resistant nickel base alloys of this class are generally somewhat similar in compositions with only a very slight variation in composition between specific alloys that make them suitable under certain conditions. Examples of this class include the alloys described in U.S. Pat. Nos. 3,160,500, 3,203,792, 4,080,201 and 4,168,188. Table 1 presents the compositions of these prior art alloys.

U.S. Pat. No. 3,160,500 relates to an alloy known herein as Alloy 625, especially suited for corrosion resistance in oxidizing acid conditions, such as sulfuric acid, containing ferric ions. The alloy is not particularly suited in reducing acid conditions, such as hot hydrochloric acid, and under conditions subject to localized corrosive attack, such as pitting in boiling oxidizing acids containing chlorides.

The alloy disclosed in U.S. Pat. No. 3,203,792 known herein as Alloy C-276 is especially suited for use under conditions subject to localized corrosive attack and hot reducing acids. However, in hot oxidizing acid this alloy is less resistant than Alloy 625 of U.S. Pat. No. 3,160,500.

The alloy disclosed in U.S. Pat. No. 4,080,201 known herein as Alloy C-4 is especially suited for use under conditions in hot reducing and oxidizing acids but not particularly resistant under conditions subject to localized corrosive attack.

The allow disclosed in U.S. Pat. No. 4,168,188, known herein as Alloy 276-F is especially suited for use as a high strength component in deep "sour gas" well applications subject to hydrogen sulfide stress cracking and the like. Corrosion resistance in various acid conditions is slightly less for this alloy when compared to Alloy C-276 disclosed in U.S. Pat. No. 3,203,792.

The comparative analysis of the prior art alloys above relates to only a limited study of corrosive characteristics of the alloys. Of course, other considerations are significant to determine the applicability of these alloys, such as costs, availability, working properties and the like. A proper conclusion of this comparison is that none of the alloys is "perfect". That is, none has the best resistance to *all* environments and media mentioned above. None has the optimum combination of corrosion resistant properties.

OBJECTS OF THE INVENTION

It is a principal object of this invention to provide an alloy that has an optimum combination of corrosion resistant properties in a variety of environments and corrosive media.

Other objects and advantages of this invention may readily be discerned by people skilled in this art.

THE INVENTION

These objects and advantages are provided in an alloy described in Table 2. All compositions are given in percent by weight, w/o, unless otherwise stated.

In many alloy systems molybdenum and tungsten may be interchangeable. This is not the case in the alloy of this invention. Molybdenum and tungsten are both required in the alloy of this invention within the ranges shown in Table 2 and, essentially, in a critical relationship, Mo:W = from 5:1 to 3:1, preferrably about 4:1, and typically at 13% molybdenum and 3.0% tungsten. The iron content in the alloy is also required within the range shown in Table 2 and preferrably, approximately in a range Fe: W = 1:1 to 3:1.

The elements carbon, silicon and manganese are impurities normally found in alloys of this class. These elements may be present adventitiously, within the range shown in Table 2. Aluminum, columbium, tantalum, titanium and vanadium may be present in the alloy as residuals of deliberate additions used in processing, such as the deoxidation step and the like. Contents of these eight elements over the ranges shown in Table 2 are deleterious and must be avoided. Sulfur and phosphorous also must be avoided and limited to less than 0.05% each.

The exact metallurgical mechanism that provides the improvements of this invention is not completely understood. It is believed that the chromium content along with the critical molybdenum-to-tungsten ratio together with the required ion content and the controlled manganese content all work in a synergistic manner to provide the optimum combination of corrosion-resistant properties.

TESTING PROGRAM

A series of alloys were prepared for testing as listed in Table 3. In the table Alloy C-276 is the commercial alloy of U.S. Pat. No. 3,302,792; Alloy C-4 is the commercial alloy of U.S. Pat. No. 4,080,201; and Alloy 625 is the commercial alloy of U.S. Pat. No. 3,160,500. An alloy of U.S. Pat. No. 4,168,188 was not tested in this series of tests. Alloys A-20 and B-20 are experimental alloys and alloy C-20 is the alloy of this invention. Table 4 presents the nominal compositions of these alloys for clarity at a glance.

TABLE 1

Compositions, w/o Prior Art Alloys

| | U.S. PAT. NO. | | | |
|---|---|---|---|---|
| | 3,160,500 | 3,203,792 | 4,080,201 | 4,168,188 |
| Chromium | 20–24 | 14–26 | 12–18 | 10–20 |
| Molybdenum | 7–11 | 3–18 | 10–18 | 12–18 |
| Tungsten | 0–8 | 0–5 | 0–7 | 0–5 |
| Columbium | 3–4.5 | — | — | — |
| Tantalum | — | — | 0.75* | — |
| Carbon | 0.1* | 0.1* | 0.02* | 0.1* |
| Silicon | 0.5* | 0–.2 | 0.08* | 0.2* |
| Manganese | 0.5* | 0–3 | 0.5* | 0–3 |
| Iron | Bal (20*) | 0–30 | 0–3 | 10–20 |
| Al., Ti. | 0.4* | — | 0.75* | — |
| Vanadium | — | — | — | 1.0* |
| Nickel plus impurities | 55–62 | 40–65 | Bal | 40–65 |

*MAXIMUM

TABLE 2

Alloys of this Invention Compositions, w/o

| | Range | Typical |
|---|---|---|
| Chromium | 20–24 | about 21–23 |
| Molybdenum | 12–17 | about 12–14 |
| Tungsten | 2–4 | about 2.5–3.5 |
| Mo:W ratio | 3:1 to 5.1 | about 4:1 |
| Columbium | .5 max | .5 max |
| Tantalum | .5 max | .5 max |
| Carbon | .1 max | .05 max |

TABLE 2-continued

| Alloys of this Invention Compositions, w/o | Range | Typical |
|---|---|---|
| Silicon | .2 max | .1 max |
| Manganese | .5 max | .5 max |
| Iron | 2–8 | about 2.5–5.5 |
| Fe:W | 1:1 to 3:1 | 1:1 to 3:1 |
| Al + Ti | .7 max | .4 max |
| Vanadium | .5 max | .5 max |
| Nickel plus impurities | Bal | Bal |

TABLE 7-continued

| 7 Vol. % $H_2SO_4$ + 3 Vol. % HCl + 1% $CuCl_2$ + 1% $FeCl_3$ Test Results (Simulating "Pitting" Conditions) | | | |
|---|---|---|---|
| Alloys | 25° C. (77° F.) | 70° C. (158° F.) | 102° C. (216° F.) |
| C-4 | No Attack | No Attack | Pitting |
| 625 | No Attack | No Attack | Pitting |
| A-20 | No Attack | Pitting | Pitting |
| B-20 | No Attack | No Attack | Pitting |
| C-20 | No Attack | No Attack | No Attack |

TABLE 3

| Tested Alloys — Chemical Composition in Weight percent, w/o | Ni | Cr | Mo | W | Fe | Si | Mn | C | Others |
|---|---|---|---|---|---|---|---|---|---|
| Prior Art Alloys | | | | | | | | | |
| C-276 | Bal | 16 | 16 | 4 | 5 | 0.08* | 1* | 0.02* | V - 0.35* |
| C-4 | Bal | 16 | 16 | — | 3* | 0.08* | 1* | 0.015* | Ti - 0.7* |
| 625 | Bal | 21.5 | 9 | — | 5* | 0.5* | 0.5* | 0.1* | Al - 0.4*, Ti - 0.04*, Cb + Ta - 3.5 |
| Experimental Alloys | | | | | | | | | |
| A-20 | Bal | 20.29 | 10.17 | 0.12 | 5.06 | 0.05 | 0.02 | 0.023 | Al - 0.3 |
| B-20 | Bal | 19.67 | 10.25 | 3.87 | 5.33 | 0.04 | 0.02 | 0.015 | Al - 0.3 |
| Alloy of this Invention | | | | | | | | | |
| C-20 | Bal | 21.96 | 13.16 | 3.01 | 3.33 | 0.05 | 0.03 | 0.024 | Al - 0.3 |

*MAXIMUM

TABLE 4

| Nominal Chemical Composition (Weight Percent) Alloys | Ni | Cr | Mo | W | Fe |
|---|---|---|---|---|---|
| C-276 | Bal | 16 | 16 | 4 | 5 |
| C-4 | Bal | 16 | 16 | — | 3 |
| 625 | Bal | 21 | 9 | — | 5 |
| A-20 | Bal | 21 | 10 | — | 5 |
| B-20 | Bal | 21 | 10 | 3 | 5 |
| C-20 | Bal | 21 | 13 | 3 | 3 |

TABLE 5

| ASTM G28 Test Results (Simulating Oxidizing Acid Conditions) Alloys | Corrosion Rates in mils per year* |
|---|---|
| C-276 | 240 |
| C-4 | 167 |
| 625 | 23 |
| A-20 | 20 |
| B-20 | 23 |
| C-20 | 29 |

*Multiply by 0.0254 to obtain millimeters per year

TABLE 6

| Boiling 10% $H_2SO_4$ Test Results (Simulating Reducing Acid Conditions) Alloys | Corrosion Rates in mils per year* |
|---|---|
| C-276 | 23 |
| C-4 | 31 |
| 625 | 46 |
| A-20 | 50 |
| B-20 | 47 |
| C-20 | 14 |

*Multiply by 0.0254 to obtain millimeters per year

TABLE 7

| 7 Vol. % $H_2SO_4$ + 3 Vol. % HCl + 1% $CuCl_2$ + 1% $FeCl_3$ Test Results (Simulating "Pitting" Conditions) Alloys | 25° C. (77° F.) | 70° C. (158° F.) | 102° C. (216° F.) |
|---|---|---|---|
| C-276 | No Attack | No Attack | No Attack |

The experimental alloys were melted as 50-pound heats by vacuum melting and each heat was cast into an electrode. The electrode was electroslag remelted (ESR) into a 4-inch diameter ingot. The ingot was hot forged at about 2050° to 2250° F. a 1½-inch thick slab then hot rolled at about 2050° to 2250° F. to a ⅛-inch plate. Following an anneal at 2050° F., the plate was pickled and finally, fashioned into the standard corrosion test specimens as required for various tests.

A series of test specimens was subjected to an oxidizing acid test. Each specimen was corrosion tested in boiling 50% $H_2SO_4$ solution containing 42 gr/liter $Fe_2(SO_4)_3$ for 24 hours. This is the standard G-28 ASTM test. Table 5 shows results of this test.

In another test, test specimens were subjected to a reducing acid test. Each specimen was corrosion tested in boiling 10% $H_2SO_4$ solution for 24 hours. This test is well known in the art. Table 6 shows results of this test.

In still another test, specimens were subjected to a "pitting" test which is a measure of localized corrosive attack. Each specimen was corrosion tested in a solution of 7 Vol.% $H_2SO_4$ plus 3 Vol.% HCl plus 1 wt.% $CuCl_2$ plus 1 wt.% $FeCl_3$ for 24 hours at three temperature levels: 25° C., 70° C. and 102° C. This test is known in the art as the "Green Death" test. Table 7 shows the results of this test.

DISCUSSION OF TESTING RESULTS

The ASTM G28 test results in Table 5 clearly show the improvement of corrosion resistance in oxidizing acid of Alloy C-20 of this invention over Alloy C-276 and Alloy C-4. These results tend to support the requirement of at least 20% chromium in the alloy.

The reducing acid test results in Table 6 clearly show Alloy C-20 of this invention has the highest corrosion resistance over all alloys tested. These results tend to support the requirement of molybdenum within the range of 12 to 15%.

The "pitting" test results in Table 7 clearly show only Alloy C-20 of this invention and Alloy C-276 were not subject to localized corrosive attack at any of the temperatures tested. These results tend to support the combined requirements of molybdenum and tungsten within the Mo:W ratio in the alloy of this invention as disclosed in Table 2.

Results of the corrosion testing of these alloys show the alloy of this invention, alloy C-20, to have the optimum combination of corrosion-resistant properties. Alloy C-20 was the only alloy of all alloys tested that had a desirable degree of corrosion-resistance in every test.

The alloy of this invention may be produced by any process now used in the manufacture of superalloys of this class, for example, Alloy C-276 and Alloy 625. The alloy may be produced in the form of castings and the form of powder for known powder metallurgy processing. The alloy has been readily welded and may be used as articles for welding: i.e., welding wire etc. The hot and cold working properties of this alloy permit the production of hot and cold rolled thin sheet, tubing and other commercial forms.

In the foregoing specification there has been set out certain preferred embodiments of this invention, however, it will be understood that this invention may be otherwise embodied within the scope of the following claims.

What is claimed is:

1. The wrought product form of an alloy consisting essentially of, in weight percent, about 22 chromium, about 13 molybdenum, about 3 tungsten, less than 0.5 columbium, less than 0.5 tantalum, less than 0.1 carbon, less than 0.2 silicon, less than 0.5 manganese, about 3 iron, less than 0.7 aluminum plus titanium, less than 0.5 vanadium and the balance nickel plus impurities wherein the ratio of molybdenum to tungsten is within the range 3:1 to 5:1, wherein the ratio of iron to tungsten is within the range 1:1 to 3:1, and wherein said ratios provide said alloy with an optimum combination of corrosion resistant properties in a variety of corrosive media and hot and cold working properties to permit production of thin sheet, tubing and other commercial forms.

* * * * *